US008966684B2

(12) United States Patent
Seehoff et al.

(10) Patent No.: US 8,966,684 B2
(45) Date of Patent: Mar. 3, 2015

(54) BED RISER STORAGE APPARATUS AND SYSTEM

(75) Inventors: Gary Stanley Seehoff, Encino, CA (US); Huy Kha Nguyen, Anaheim, CA (US)

(73) Assignee: Evriholder Products, LLC, Anaheim, CA (US)

( * ) Notice: Subject to any disclaimer, the term of this patent is extended or adjusted under 35 U.S.C. 154(b) by 0 days.

(21) Appl. No.: 13/008,944

(22) Filed: Jan. 19, 2011

(65) Prior Publication Data

US 2012/0180216 A1 Jul. 19, 2012

(51) Int. Cl.

| | |
|---|---|
| ***A47C 21/00*** | (2006.01) |
| ***A47C 31/00*** | (2006.01) |
| ***F16M 11/24*** | (2006.01) |
| ***A47C 19/02*** | (2006.01) |

(52) U.S. Cl.

CPC ..... *A47C 19/024* (2013.01); *A47C 21/00* (2013.01)

USPC ..... 5/503.1; 5/509.1; 5/658; 248/188.2

(58) Field of Classification Search

CPC ..... A47C 21/00; A47C 19/045; A61G 7/05; A61G 7/012

USPC ..... 5/503.1, 509.1, 658, 660, 11, 905; 248/188.2

See application file for complete search history.

(56) References Cited

U.S. PATENT DOCUMENTS

| | | | | | |
|---|---|---|---|---|---|
| 2,072,791 | A * | 3/1937 | Baer | 248/407 |
| 2,260,715 | A * | 10/1941 | Ketchem | 200/85 R |
| 2,893,164 | A * | 7/1959 | Martin | 248/188.2 |
| 2,933,850 | A * | 4/1960 | Martin | 248/188.2 |
| 3,795,925 | A * | 3/1974 | Leagus, Jr. | 5/611 |
| 4,312,088 | A * | 1/1982 | Webb | 5/600 |
| 5,224,227 | A * | 7/1993 | McGinley | 5/509.1 |
| 5,345,631 | A * | 9/1994 | Saperstein et al. | 5/509.1 |
| 5,615,429 | A * | 4/1997 | Williams | 5/509.1 |
| 6,012,185 | A * | 1/2000 | Woods et al. | 5/509.1 |
| 6,575,414 | B2 * | 6/2003 | Cuzzocrea | 248/188.2 |
| 6,892,991 | B1 * | 5/2005 | Soh | 248/188.2 |
| 6,948,688 | B1 * | 9/2005 | Payne et al. | 248/188.2 |
| 6,968,583 | B1 * | 11/2005 | Rich | 5/509.1 |
| 7,020,916 | B1 * | 4/2006 | Agre et al. | 5/509.1 |
| 7,281,283 | B2 * | 10/2007 | Agre et al. | 5/509.1 |
| 2001/0023509 | A1 * | 9/2001 | Becker et al. | 5/509.1 |
| 2012/0180216 | A1 * | 7/2012 | Seehoff et al. | 5/503.1 |

* cited by examiner

*Primary Examiner* — Robert G Santos

(57) ABSTRACT

A bed riser storage device including at least one holder portion. The bed riser storage device connects with a bed riser. A system with a bed riser storage device including at least one holder portion, and a bed riser removably connected to a bed leg.

26 Claims, 6 Drawing Sheets

BED RISER STORAGE APPARATUS AND SYSTEM

BACKGROUND

1. Field

The embodiments relate to bed risers, and in particular to an apparatus, system and kit for bed riser storage devices.

2. Description of the Related Art

Bed risers are used by individuals for appearance, medical reasons and to increase the height of a bed frame in order to store large items under a bed. Bed risers serve the purpose of raising a bed a desired amount, either at one end or both ends of the bed.

SUMMARY

One embodiment of the invention includes a bed riser storage device including at least one holder portion. The bed riser storage device couples with a bed riser.

Another embodiment of the invention is a system including a bed riser storage device including at least one holder portion, and a bed riser removably coupled to a bed leg.

Yet another embodiment of the invention includes a kit comprising: at least one bed riser storage device including at least one holder portion, and a plurality of bed risers. The at least one bed riser storage device couples to one bed riser of the plurality of bed risers.

Other aspects and advantages of the present invention will become apparent from the following detailed description, which, when taken in conjunction with the drawings, illustrate by way of example the principles of the invention.

BRIEF DESCRIPTION OF THE DRAWINGS

The embodiments are illustrated by way of example, and not by way of limitation, in the Figures of the accompanying drawings and in which like reference numerals refer to similar elements and in which.

DETAILED DESCRIPTION

The following description is made for the purpose of illustrating the general principles of the invention and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

The description may disclose several preferred embodiments of bed riser storage devices, bed riser storage device systems and kits, as well as operation and/or component parts thereof. While the following description will be described in terms of bed riser storage device systems and devices for clarity and to place the invention in context, it should be kept in mind that the teachings herein may have broad application to all types of systems, devices and applications.

One embodiment of the invention provides a bed riser storage device including at least one holder portion. The bed riser storage device couples with a bed riser. In one example, the bed riser storage device connected with a bed riser that is used for connecting to a leg of a bed provides a storage area located under a bed for access by a user. The use of the bed riser storage device assists user in storing items out of the way and within reach. In one example, a user stores items typically placed on a night stand, such as a remote control(s), a cell phone, eye glasses, a TV programming guide, etc.

Figure 1:
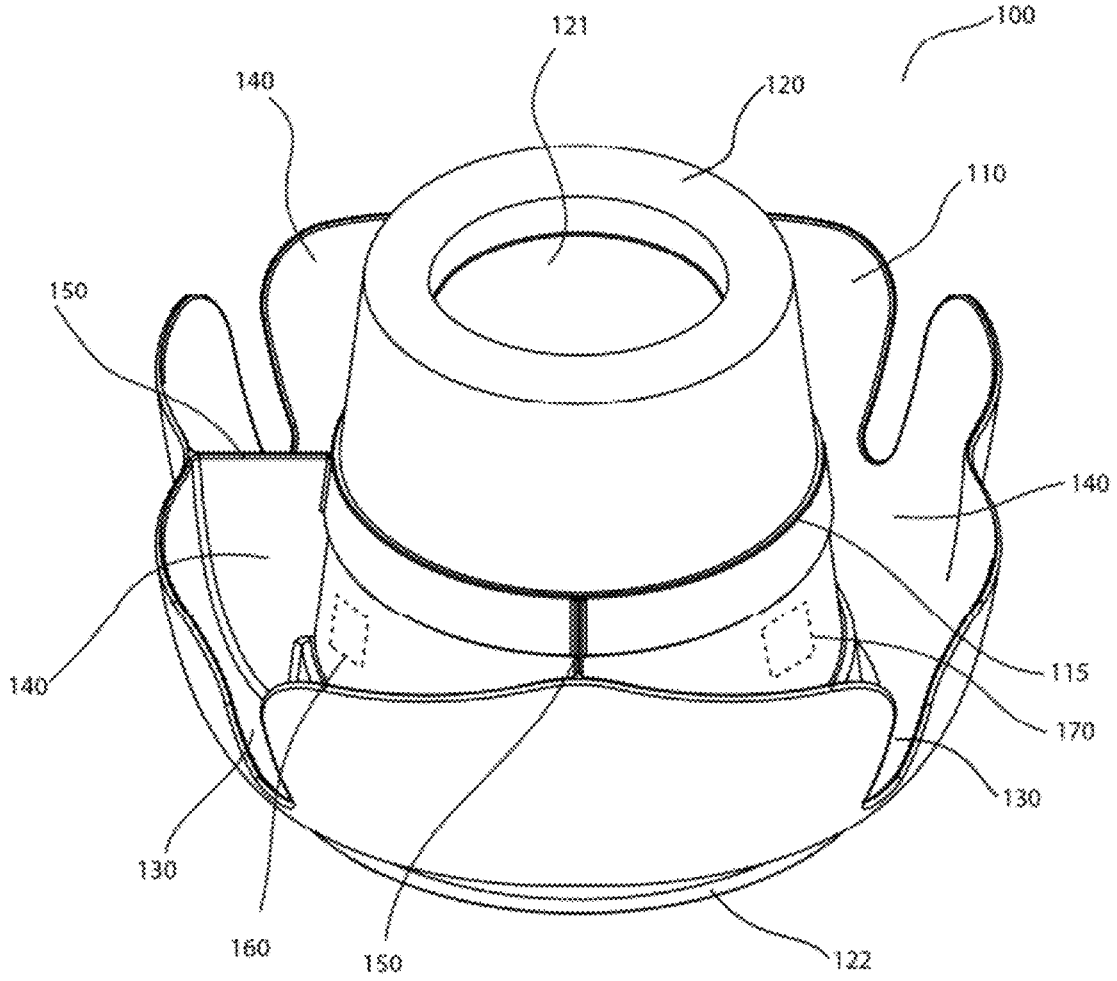
FIG. 1 illustrates a perspective view of a bed riser storage device system according to one embodiment of the invention.

FIG. 1 illustrates bed riser storage device system 100 according to one embodiment of the invention. In one embodiment of the invention, the bed riser storage device system 100 includes a bed riser storage device 110 and a bed riser 120. In one example, the bed riser storage device 110 includes at least one holder portion or pocket 140. In one embodiment of the invention, two or more holder portions 140 (e.g., 2, 3, 4, etc.) are included in the bed riser storage device 110. In this embodiment of the invention, the two or more holder portions 140 are separated by a divider portion 150. In one example, the two or more holder portions 140 may have the same or different sizes.

In one embodiment of the invention, bed riser storage device 110 includes a coupling portion 115. In one example, the coupling portion 115 is shaped to slide over a bed riser 120. In other examples, the coupling portion may comprise two portions that connect together (e.g., snap together, bolt/screw together, etc.) around a bed riser 120. In one embodiment of the invention, the coupling portion has a round or conical shape that matches a conical shaped bed riser 120. In other examples, the coupling portion 115 may have different shapes for attaching to different shaped bed risers 120, such as square, rectangular, round, cylindrical, polygonal, etc. It should be noted that while a conical shaped bed riser 120 is shown in FIG. 1, in other examples the bed riser storage device 110 may have a corresponding shape to the different shaped bed risers 120.

In one embodiment of the invention, the bed riser storage device 110 is a separate device that attaches to standard bed risers, either removably or irremovably. In another embodiment of the invention, the bed riser storage device 110 is integrated with a bed riser 120. In yet another embodiment of the invention, the bed riser storage device 110 and the bed riser 120 are manufactured in a contiguous single device via molding or extrusion processes.

In one embodiment of the invention, the bed riser 120 is shaped to hold a bed leg, a bed footing or a wheel/roller through an opening in a depression 121. In one embodiment of the invention, the bed riser storage device 110 is positioned a predetermined height above a base portion 122 of the bed riser 120. In one example, the bed riser storage device 110 rotates around the bed riser 120 providing easy access to the storage portions 140 by a user. In another example, the bed riser storage device 110 is fixed to the bed riser 120.

In one embodiment of the invention, the bed riser 120 includes a storage portion or pocket that is hidden from sight and internal to the bed riser 120. In one example, the storage portion within the bed riser 120 locks into place and opens via a spring locking/releasing mechanism. In this example, devices may be hidden from sight when desired. In another example, a storage portion(s) 140 are only located on one portion of the bed riser storage device 110 (e.g., one half, one third, etc.). In this example, the bed riser storage device 110 may be rotated so that the storage portion(s) 140 are facing underneath a bed and cannot be seen.

In one embodiment of the invention, the bed riser storage device 110 includes a wire management portion 130. In one example, the wire management portion 130 provides a slot for wires from power sources or charging devices that are connected to stored electronic devices, such as cell phones, cameras, etc. The wire management portion 130 provides a user with a way to organize electrical wires to reduce the possibility of wires becoming tangled or damaged, makes it easy for wires from different devices to be separated, provides a clean look as opposed to multiple wires laying together on the floor, etc.

In one embodiment of the invention, the bed riser storage device 110 includes an electrical device connector portion 160. In one example, the electrical connector portion 160 is a USB connector. In another example, the electrical connector portion 160 includes a retractable USB connector for powering/charging electronic devices. In one embodiment of the invention, bed riser storage device 110 includes a light source 170 connected to a power source, such as one or more batteries, a USB connector, etc. In one example, the light source 170 is a LED light source that provides lighting to the holder portion(s) 140 and surrounding area. In another example, the bed riser storage device 110 includes more than one light source 170, such as two, three, four, etc. In other examples, other types of light sources may be employed, such as Electroluminescent (EL) light sources, etc. In one embodiment of the invention, the bed riser storage device 110 includes glow-in-the-dark material.

In one example, the bed riser 120 and bed riser storage device 110 may be made of one or more of: reinforced polypropylene, polypropylene, high-density polyethylene, nylon material, hardened plastic, polymer, wood, rubber, composite material, metal or metal alloy, etc., or similar materials.

In one example, the bed riser 120 has a height range from 4-8 inches, preferably 6 inches, and a diameter range of between 4-9 inches, preferably 6.5 inches. In one example, the bed riser storage device system 100 raises a bed 3-8 inches, preferably 6 inches. In one example, each bed riser 120 supports about 300 pounds.

Figures 2A, 2B:
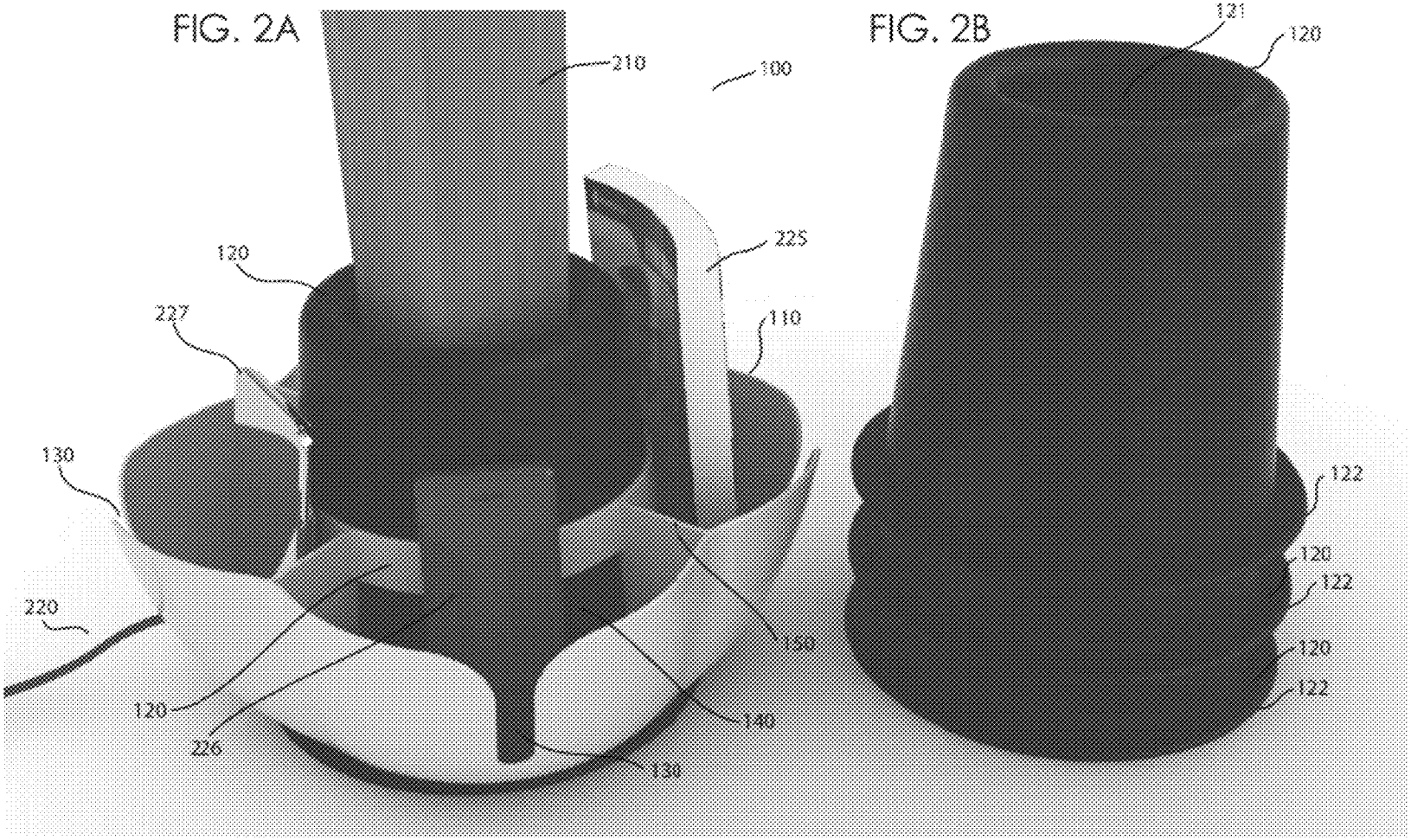
FIG. 2A illustrates a perspective view of a bed riser storage device system shown in FIG. 1, shown with a bed leg inserted into the bed riser and various items stored in the bed riser storage device.
FIG. 2B illustrates a stack or bed risers without the bed riser storage devices.

FIG. 2A illustrates a bed riser storage device system 100 shown with a bed leg 210 inserted in the opening of depression 121 of the bed riser 120 according to one embodiment of the invention. In one example, a small book 225, a remote control 226 and 1 cell phone 227 are shown within holder portions 140. A charging wire connector 229 (e.g., USB connector) is placed on a wire management portion 130.

FIG. 2B illustrates a stack of three bed risers 120. In one embodiment of the invention, a kit includes the four bed risers 120 and one bed riser storage device 110 shown in FIGS. 2A and 2B. In another example, a kit may include two bed riser storage devices 110 and four bed risers 120. Other kits may include other embodiments of the invention, such as integrated bed riser storage devices 110 and bed risers 120, etc.

Figure 3:
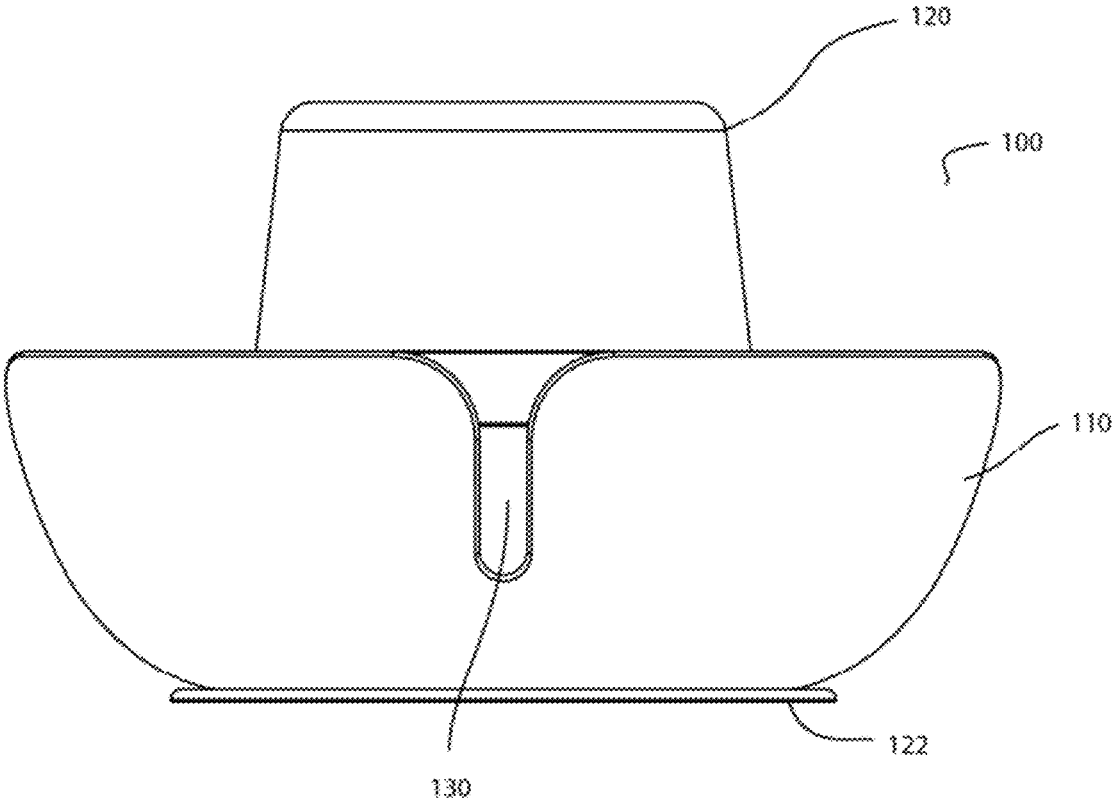
FIG. 3 illustrates a side view of a bed riser storage device system.

FIG. 3 illustrates a side view of bed riser storage device system 100. As illustrated, the wire management portion 130 is shown as a slot or groove. In other embodiments of the invention, the wire management portion 130 may comprises multiple slots or grooves for separating and managing electronic device wires.

Figure 4:
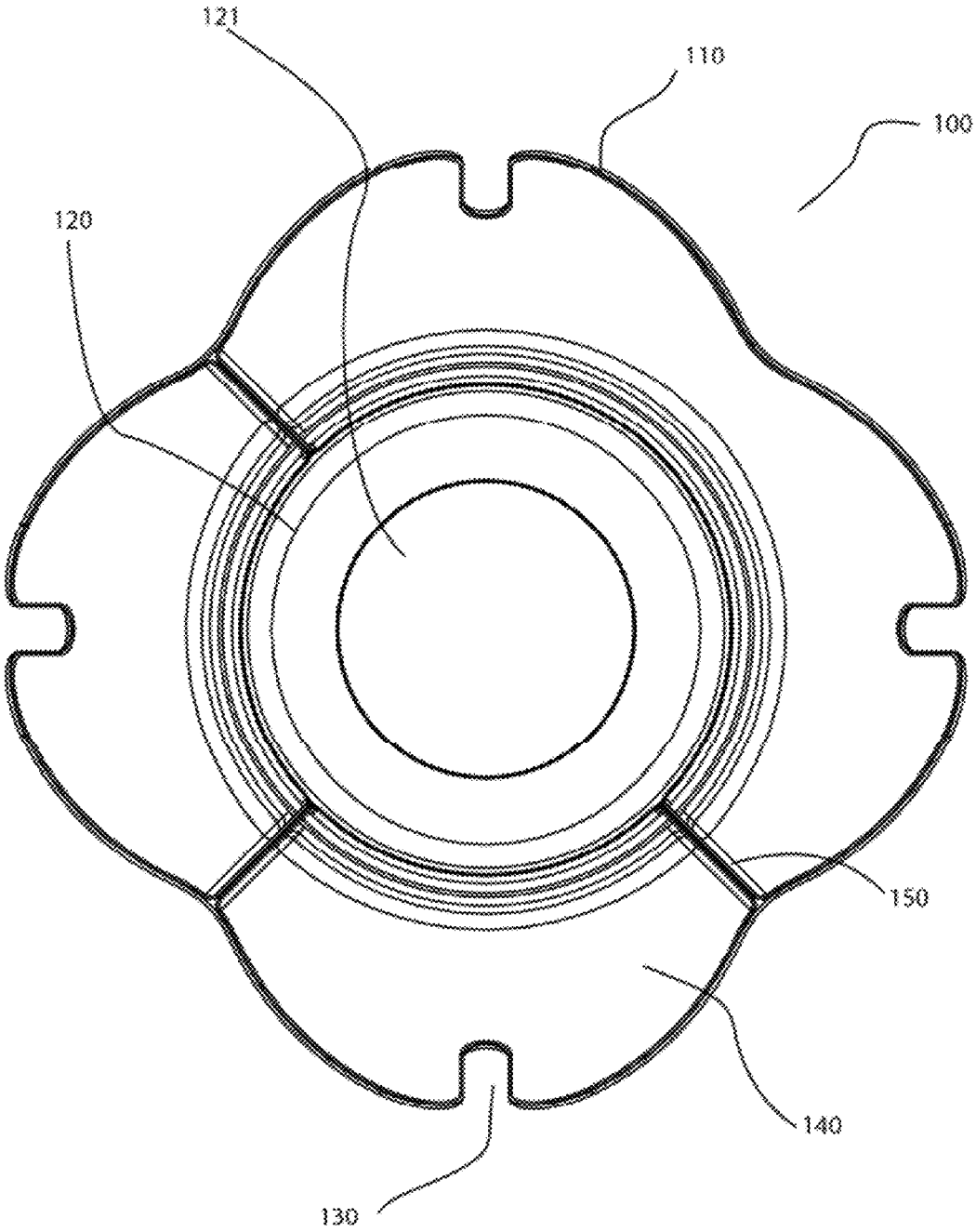
FIG. 4 illustrates a top view of the bed riser storage device system.
Figure 5:
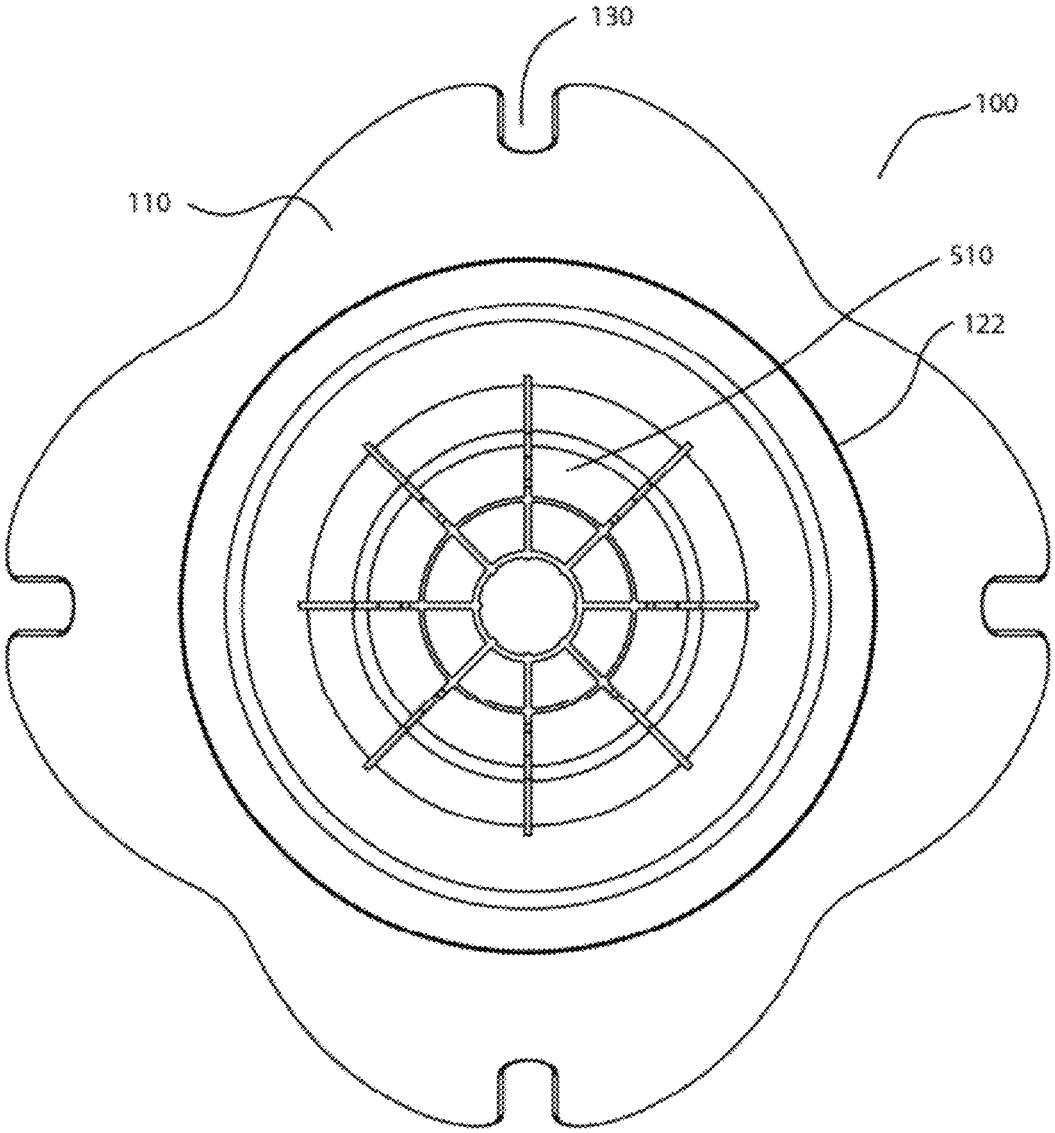
FIG. 5 illustrates a bottom view of the bed riser storage device system.

FIG. 4 illustrates a top view of bed riser storage device system 100. FIG. 5 illustrates a bottom view of bed riser storage device system 100. In one example, support portion 510 comprises a reinforced design including a "webbed" molded structure for added strength.

Figure 6:
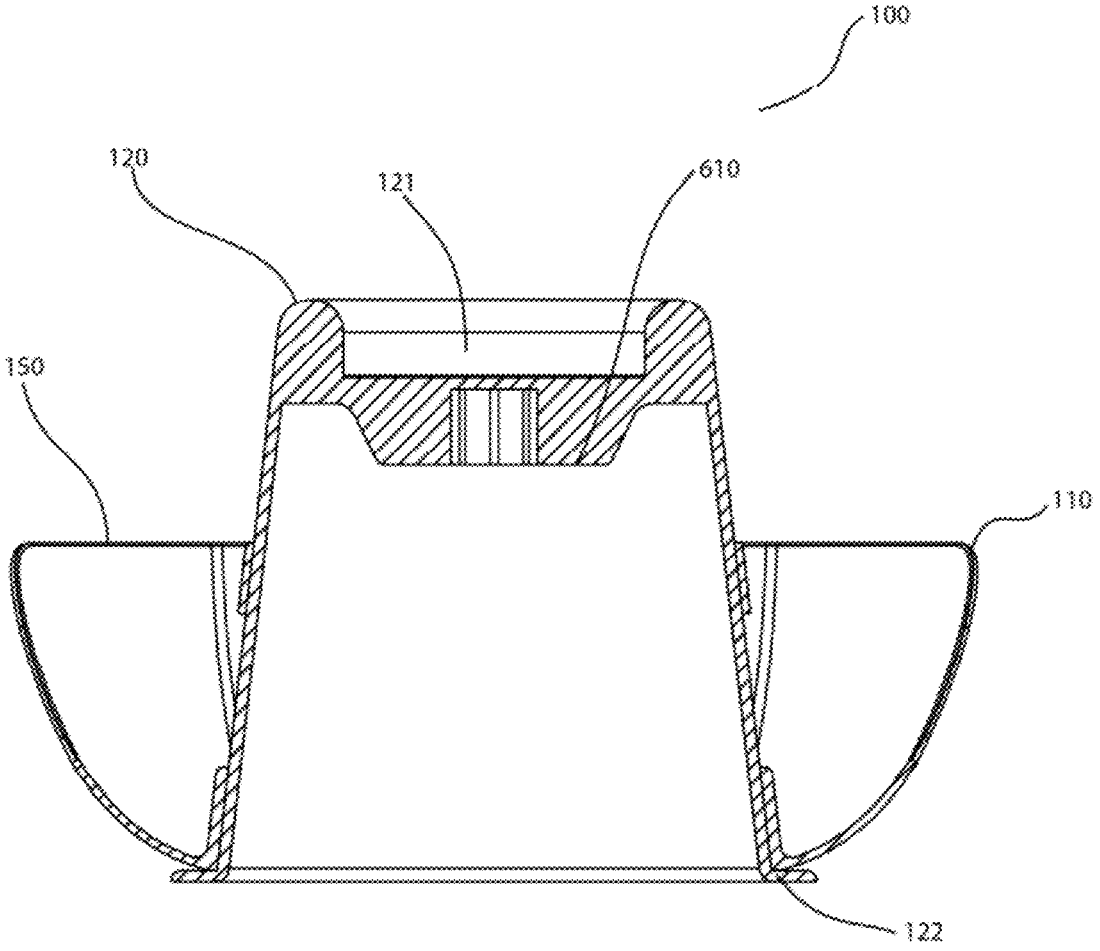
FIG. 6 illustrates a cross-sectional view of the bed riser storage device system.

FIG. 6 illustrates a cross-section view of the bed riser storage device system 100. As illustrated, the bed leg support portion 610 has a height above the base portion 122, which raises a bed upon a bed leg (e.g., bed leg 210 shown in FIG. 2A) being placed in the depression portion 121.

It should be noted that while the various embodiments of the invention and examples are related to raising a bed, other uses for the bed riser storage device 110 and bed riser storage device system 100 may be employed, such as using the bed riser storage device 110 and bed riser storage device system 100 for other furniture, such as chairs, couches, desks, etc.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An apparatus comprising:

a bed riser storage device including two or more holder portions each including an interior pocket with an outer wall portion and are separated by a divider portion, wherein the two or more holder portions each including a wire management portion comprising a slot in the outer wall portion, wherein the bed riser storage device is configured for coupling with a bed riser by sliding over an exterior portion of the bed riser, and the two or more holder portions are disposed outwards from an exterior circumference of the exterior portion of the bed riser when the bed riser storage device is coupled with the bed riser.

2. The apparatus of claim 1, wherein the bed riser storage device includes a round coupling portion coupled to the two or more holder portions, wherein the two or more holder portions are configured for holding a plurality of accessible personal items.

3. The apparatus of claim 1, wherein the bed riser storage device is removably coupled with the bed riser.

4. The apparatus of claim 1, wherein each wire management portion includes a curved lower portion in the slot.

5. The apparatus of claim 4, wherein the bed riser storage device comprises an electrical device connector portion.

6. The apparatus of claim 1, wherein the bed riser storage device comprises at least three holder portions, and another divider portion separates two of the holder portions.

7. The apparatus of claim 6, wherein the bed riser storage device is rotatably coupled to the exterior portion of the bed riser.

8. The apparatus of claim 1, wherein the bed riser storage device and the bed riser are separate devices.

9. The apparatus of claim 2, wherein the coupling portion is sized and shaped for coupling with an upper portion of the exterior portion of the bed riser.

10. The apparatus of claim 1, wherein the bed riser storage device includes a coupling portion coupled to the two or more holder portions, wherein the coupling portion has one of a conical shape, a square shape, a round shape and a polygonal shape.

11. A system comprising:

a bed riser storage device including two or more holder portions each including an interior pocket with an outer wall portion and are separated by an integrated divider portion, wherein the two or more holder portions each including a wire management portion comprising a slot in the outer wall portion; and a bed riser configured for removably coupling to a bed leg, wherein the bed riser storage device is configured for removably coupling to an exterior portion of the bed riser, wherein the two or more holder portions are disposed outwards from an exterior circumference of the exterior portion of the bed riser when the bed riser storage device is coupled with the bed riser.

12. The system of claim 11, wherein the bed riser storage device includes a round coupling portion coupled to the two or more holder portions.

13. The system of claim 12, wherein each wire management portion includes a curved lower portion in the slot.

14. The system of claim 12, wherein the bed riser storage device comprises an electrical device connector portion.

15. The system of claim 12, wherein the bed riser storage device comprises at least three holder portions, and another divider portion separates two of the holder portions.

16. The system of claim 12, wherein the bed riser storage device is configured for rotatably coupling to the exterior portion of the bed riser.

17. The system of claim 12, wherein the bed riser storage device slides onto the exterior portion of the bed riser or attaches around the exterior portion of the bed riser.

18. The system of claim 12, wherein the coupling portion is sized and shaped for coupling around the exterior portion of the bed riser.

19. The system of claim 11, wherein the bed riser storage device includes a coupling portion integrated with the two or more holder portions, wherein the coupling portion has one of a conical shape, a square shape, a round shape and a polygonal shape.

20. The system of claim 12, wherein the bed storage device includes a light source.

21. A kit comprising:

at least one bed riser storage device including two or more holder portions each including an interior pocket with an outer wall portion and are separated by a divider portion that is integrated with a coupling portion, wherein the two or more holder portions each including a wire management portion comprising a slot in the outer wall portion; and a plurality of bed risers, wherein the at least one bed riser storage device is configured for coupling to an exterior portion of one bed riser of the plurality of bed risers, and the two or more holder portions of the at least one bed riser storage device are disposed outwards from an exterior circumference of the exterior portion of the one bed riser when the at least one bed riser storage device is coupled to the one bed riser.

22. The kit of claim 21, wherein the bed riser storage device is one of integrated with the one bed riser, or removably coupled to an exterior portion of the one bed riser.

23. The kit of claim 21, wherein each wire management portion includes a curved lower portion in the slot.

24. The kit of claim 21, wherein the bed riser storage device comprises an electrical device connector portion.

25. The kit of claim 21, wherein the bed riser storage device comprises at least three holder portions, and another divider portion separates two of the holder portions.

26. The kit of claim 21, wherein the bed riser storage device is configured for rotatably coupling to the exterior portion of the one bed riser.

* * * * *